United States Patent [19]

Nicklas et al.

[11] Patent Number: 4,536,928

[45] Date of Patent: Aug. 27, 1985

[54] MANUFACTURE OF PROJECTILES

[75] Inventors: Roger W. Nicklas, Hamel; John E. Reynolds, Crystal; Randall L. Schiestl, Brooklyn Park, all of Minn.

[73] Assignee: Honeywell Inc., Minneapolis, Minn.

[21] Appl. No.: 552,651

[22] Filed: Nov. 17, 1983

[51] Int. Cl.[3] ..... B21K 21/06

[52] U.S. Cl. ..... 29/1.2

[58] Field of Search ..... 29/1.2, 1.23; 102/503, 102/513, 520, 521, 522, 523

[56] References Cited

U.S. PATENT DOCUMENTS

| | | | |
|---|---|---|---|
| 3,662,686 | 5/1972 | Baldini | 102/523 |
| 3,902,424 | 9/1975 | Dietsch et al. | 102/513 |
| 4,215,632 | 8/1980 | Sie | 102/521 |
| 4,249,466 | 2/1981 | Rossman et al. | 102/513 |

*Primary Examiner*—Howard N. Goldberg
*Assistant Examiner*—Steven Nichols
*Attorney, Agent, or Firm*—George W. Field

[57] ABSTRACT

A method of making a long rod penetrator having a rearward vane section which comprises forming the vane section by stamping a plurality of vanes from sheet metal and welding them to the rear portion of the penetrator.

8 Claims, 6 Drawing Figures

MANUFACTURE OF PROJECTILES

The Government has rights in this invention pursuant to Contract No. DAAK10-82-C-296.

FIELD OF THE INVENTION

This invention relates to the field of munitions, and more particularly to an improved method for producing munitions of the type known as "penetrators" for use against armored targets, which method has advantages of speed and low cost.

BACKGROUND OF THE INVENTION

In the field of munitions it is often necessary to attack targets which are armored so that simple explosion of a munition against the armor is not sufficient to disable the target.

For such uses there have been developed projectiles known as "penetrators" which are not explosive, but are of density, configuration, and propulsion for maximum penetration force. One such device is known as a "long rod penetrator": it is of tungsten and is of relatively small diameter compared to its length, and extends along an axis from a forward aerodynamic point to a rearwared stabilizing fin structure. In order to obtain a high degree of propulsion the penetrators are arranged for firing from cartridge cases of several times the diameter of the penetrator, the case initially enclosing the rear portion of the penetrator including the fin structure. The mouth of the cartridge case must be large enough to pass the fin structure, so a sabot is fitted to the mid portion of the penetrator to initially close the mouth of the cartridge case and subsequently guide the penetrator down the barrel of the discharging cannon. The sabot and the fin structure contribute nothing to the penetrating power of the projectile, but add to the mass which must be accelerated from the cannon, and hence decrease the nozzle velocity obtainable for any given propulsion charge. The sabot is designed for aerodynamic disintegration when the penetrator leaves the cannon barrel, but the fin structure must remain functional during the flight of the projectile.

BRIEF SUMMARY OF THE INVENTION

The present invention comprises an improved method for manufacturing penetrators of a special design particularly pointed out in our copending application filed of even date herewith and assigned to the assignee of the present invention. In brief, the invention dispenses with the slow and expensive machining of a complex cruciform structure from the solid metal, and instead substitutes a sequence of simple turning, stamping, and welding operations as will be explained in detail below.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

BRIEF DESCRIPTION OF THE DRAWING

In the drawing, in which like reference numerals identify corresponding parts throughout the several views.

DESCRIPTION OF THE PREFERRED EMBODIMENT

Figure 1:
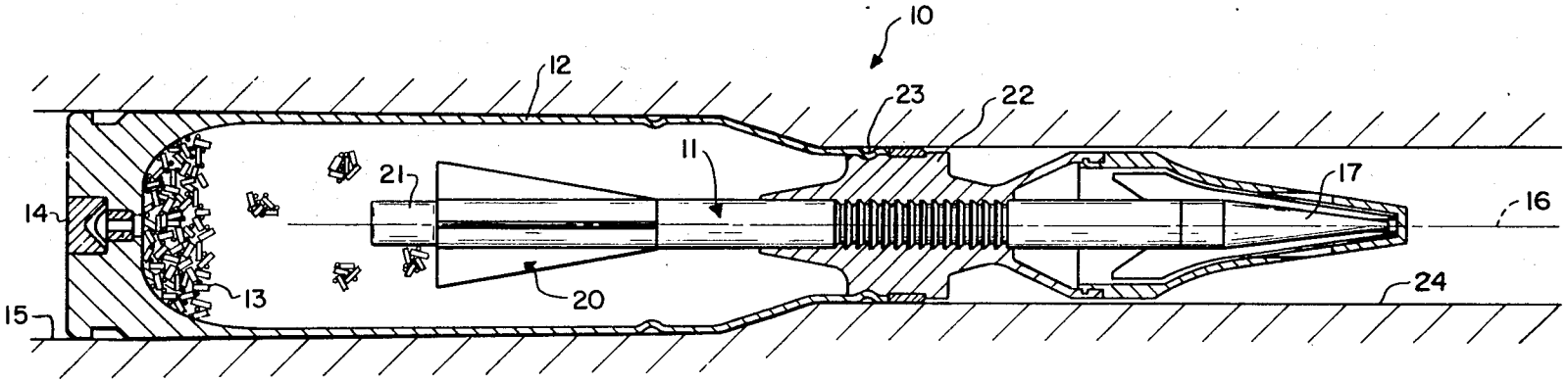
FIG. 1 is a general view partly in section of a munition of the type in question.
Figure 5:
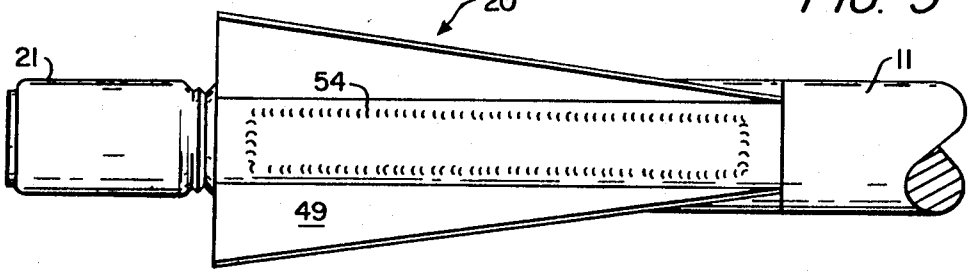
FIGS. 5 and 6 are side and end views of a completed penetrator.

Turning first to FIG. 1, there is shown a munition 10 including a penetrator 11 arranged for firing from a cartridge case 12 containing a propulsion explosive 13 which is fired when a primer or percussion cap 14 is impacted by the firing mechanism of the cannon, not shown. The munition is shown to be enclosed within the chamber 15 of the cannon.

The penetrator which may be of heavy metal such as tungsten, is shown to extend along an axis 16 from a forward portion 17, pointed for aerodynamic reasons, to a rearward fin structure 20 for flight stabilization, and a tracer compartment 21. A sabot 22 holds the penetrator in the mouth 23 of the cartridge case and guides the penetrator as it is propelled through the barrel 24 of the cannon. In one successful embodiment of the invention the barrel diameter of the cannon is twenty-five millimeters.

Figure 2:
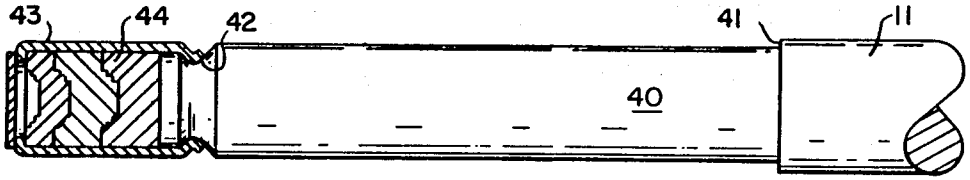
FIG. 2 is a fragmentary showing of the rear end of a penetrator during manufacture according to the invention.
Figure 4:
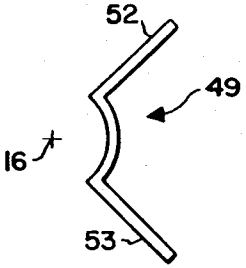
FIGS. 3 and 4 are plan and end views of one of the stamped fin sections used in practicing.
Figure 3:
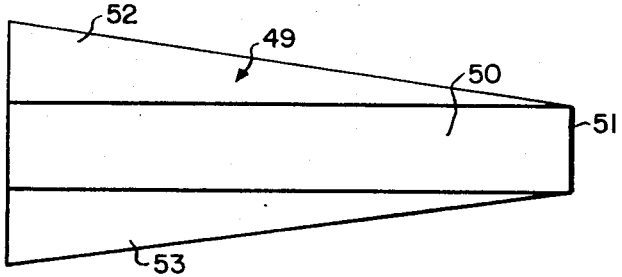
Figure 6:
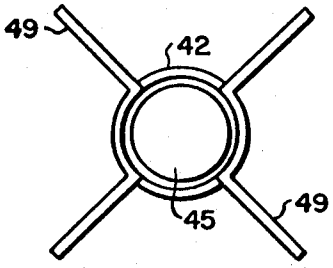

FIG. 2 shows how a penetrator is prepared rearwardly to receive a fin structure according to the invention. A portion 40 of reduced diameter is formed on the penetrator, extending rearwardly from a shoulder 41 to a groove 42 formed at the end, to which is crimped a container 43 of tracer material 44, the container being of no greater diameter than the penetrator.

A plurality of fin sections 49 are prepared by a simple stamping process, from sheet metal which may be if desired of great density such as tungsten. Each fin section includes a central base 50 which is arcuate to correspond to the configuration of reduced portion 40, and has a square end 51 to engage shoulder 41. A pair of vanes 52 and 53 are formed to extend radially outward from base 50 in orthogonal planes which intersect at axis 16. The vanes increase in radial dimension from end 51 rearwardly. While the design shown uses two stampings for each penetrator, with the vanes lying in orthogonal planes, other angles are possible such as vanes defining dihedral angles of 120° rather than of 90°, but the design shown is believed to be preferable.

To complete the manufacture of the penetrator, a pair of fin sections 49 are jigged against a penetrator rear portion 40 with their vanes lying in mutually orthogonal planes and intersecting at axis 16, and the fin sections are laser welded to the penetrator as suggested at 54. It has been determined that the heat resulting from this rapid welding procedure is not sufficient to ignite tracer material 44.

The penetrators are then fitted with sabots and inserted in cartridge cases of propulsive material in the usual fashion.

From the above it will be evident the invention comprises a method for fitting penetrators with stabilizing fin structures constructed by simple stamping and welding operations.

Numerous characteristics and advantages of the invention have been set forth in the foregoing description, together with details of the structure and function of the invention, and the novel features thereof are pointed out in the appended claims. The disclosure, however, is illustrative only, and changes may be made in detail especially in matters of shape, size, and arrangement of parts, within the principle of the invention, to the full extent indicated by the broad general meaning of the terms in which the appended claims are expressed.

The embodiments of the invention in which an exclusive property or right is claimed are defined as follows:

1. The method of making a long rod penetrator having an axis and a rearward portion which comprise stamping from sheet metal a plurality of fin sections having base portions configured for superficial engagement with said rearward portion and vane portions extending therefrom in orthogonal planes, and laser welding said fin sections to said rearward portion so that said vanes lie in common planes passing through said axis.

2. The method of claim 1 which includes a further step of forming the end of said rearward portion to crimpingly receive a container of tracer material.

3. The method of claim 2 which includes the step of securing a container of tracer material to said end of said rearward portion before said fin sections are welded thereto.

4. The method of making a long rod penetrator having an axis and a rearward portion which comprises forming a reduced portion on said rearward portion extending rearward from a shoulder, stamping from sheet metal a plurality of fin sections having base portions configured for superficial engagement with said reduced portion and vane portions extending therefrom in orthogonal planes, and laser welding said fin sections to said reduced portion so that said vanes lie in common planes passing through said axis.

5. The process of making a long rod penetrator having a longitudinal axis and a rearward portion which comprises the steps of stamping, from thin sheet metal, a fin section having a base portion configured to superficially engage said rearward portion and at least one vane configured to extend radially outward from said axis, and laser welding the base portion of the fin section to the rearward portion of the penetrator.

6. The process of claim 5 which includes the step of securing the base portions of a plurality of said fin sections to said rearward portion of said penetrator so that said vanes extend outwardly from said axis in coincident planes.

7. The process of claim 5 which includes the step of securing the base portions of a plurality of said fin sections to said rearward portion of said penetrator so that said vanes extend outwardly from said axis in mutually orthogonal planes.

8. The process of claim 5 which includes the step of securing the base portions of a plurality of said fin sections to said rearward portion of said penetrator so that said vanes extend outwardly from said axis in coincident, mutually orthogonal planes.

* * * * *